US005536531A

United States Patent [19]

Owen et al.

[11] Patent Number: 5,536,531

[45] Date of Patent: Jul. 16, 1996

[54] APPLICATOR FOR SHEAR THINNING VISCOUS COATING MATERIALS

[75] Inventors: Ian R. Owen, River Falls, Wis.; Alan G. McKown, Oakdale, Minn.

[73] Assignee: Minnesota Mining and Manufacturing Company, St. Paul, Minn.

[21] Appl. No.: 280,377

[22] Filed: Jul. 26, 1994

[51] Int. Cl.[6] ..... B05D 5/00; B05B 7/06

[52] U.S. Cl. ..... 427/256; 427/421; 239/424; 222/326

[58] Field of Search ..... 427/256, 421; 118/300, 407; 222/148, 325, 326, 391, 566, 567, 568; 239/416.5, 424

[56] References Cited

U.S. PATENT DOCUMENTS

| | | | |
|---|---|---|---|
| 2,645,527 | 7/1953 | Walters | 299/140 |
| 3,288,333 | 11/1966 | Valk, Jr. | 222/95 |
| 3,746,253 | 7/1973 | Walberg | 239/15 |
| 3,997,085 | 12/1976 | Lindquist | 222/326 |
| 4,174,068 | 11/1979 | Rudolph | 239/322 |
| 4,570,832 | 2/1986 | Kroger | 222/325 |
| 5,199,644 | 4/1993 | Haferhorn | 239/296 |
| 5,301,835 | 4/1994 | Fulks et al. | 222/95 |
| 5,301,839 | 4/1994 | Eierle et al. | 222/95 |

FOREIGN PATENT DOCUMENTS

| | | | |
|---|---|---|---|
| 0440149A2 | 8/1991 | European Pat. Off. . | |
| 0525562A1 | 7/1992 | European Pat. Off. | B05C 17/015 |
| 0589075A1 | 9/1992 | European Pat. Off. | B05B 7/06 |
| 90009576 | 5/1990 | Germany . | |
| 9011965.7 | 11/1990 | Germany . | |
| 4026170A1 | 2/1992 | Germany . | |
| 669165A5 | 2/1989 | Switzerland . | |

OTHER PUBLICATIONS

Building Design and Construction Handbook, F. S. Merritt & J. T. Ricketts (Eds) 5th Edition, 1994, Sections 4.86–4.87.

Encyclopedia of Chemical Technology, vol. 6, pp. 414–415 3rd Ed. 1979 John Wiley & Sons, N.Y.

*Primary Examiner*—Shrive Beck
*Assistant Examiner*—Fred J. Parker
*Attorney, Agent, or Firm*—Gary L. Griswold; Walter N. Kirn; William L. Heubsch

[57] ABSTRACT

A pneumatic applicator for shear thinning viscous coating materials that includes a nozzle, an air operated system for dispensing viscous material at a steady rate through the nozzle, and an air directing housing defining an air chamber around the nozzle. The air directing housing defines an air outlet opening for the air chamber around the nozzle. Distal surfaces of the housing and nozzle are close to co-planar and the air outlet opening has an area in the range of about 5 to 15 square millimeters. An adjustable system directs air under pressure into the air chamber so that when the viscous material is dispensed through the nozzle at a generally uniform rate, air can be directed into the chamber and out through the air outlet opening around the nozzle and only the amount of air being directed into the chamber need be adjusted to cause viscous material being dispensed from the nozzle to be applied to a surface adjacent the nozzle in coatings of various widths and thicknesses.

5 Claims, 7 Drawing Sheets

APPLICATOR FOR SHEAR THINNING VISCOUS COATING MATERIALS

TECHNICAL FIELD

The present invention relates to applicators and methods for applying shear thinning viscous coating materials, which applicator and methods can be used to apply the coatings in various widths and thicknesses.

BACKGROUND ART

German Patent Publication DE 4,026,170 A1 describes an applicator that can be used to apply coatings of shear-thinning, viscous coating materials and can be adjusted to apply those coatings in various widths and thicknesses. That applicator, however, mixes air and the viscous material in a chamber around the tip of a nozzle within the applicator, which mixing requires that the nozzle and a wall defining a mixing chamber around the outer surface of the nozzle be either disposed of and/or cleaned of the coating material after the applicator is used. Also, changing the width of the coating applied requires changing the size of the mixing chamber around the outer surface of the nozzle, so that obtaining coatings of different width and thickness is less easily done than may be desired.

DISCLOSURE OF INVENTION

The present invention provides an applicator and a method for applying shear thinning viscous coating materials in which the coatings can be more easily adjusted to have various widths and thicknesses than with known prior art applicators, and after the coatings are applied, the applicator by which they are applied can be more easily and economically cleaned than known prior art applicators so that the applicator is easily made ready for use in subsequent applications of such materials. Also, the applicator is adapted to apply the coating materials from a type of package that, when emptied, leaves a small amount of packaging material to be disposed of.

According to the present invention there is provided a method for applying shear thinning viscous coating materials having a predetermined range of properties to substrates as coatings with various widths and thicknesses. That predetermined range of properties for the shear-thinning viscous coatings includes a low shear rate viscosity in the range of 100,000 to 800,000 centipoise and preferably in the range of 300,000 to 600,000 centipoise as measured with a Brookfield viscometer at 2 revolutions per minute using a number 7 spindle; a high shear viscosity in the range of 40,000 to 100,000 centipoise and preferably in the range of 60,000 to 80,000 centipoise as measured with a Brookfield viscometer at 20 revolutions per minute using a number 7 spindle; and a thixotropy index, defined as the ratio of the low shear rate viscosity to the high shear rate viscosity, that is greater than 4, preferably is greater than 5, and most preferably is greater than 6 (i.e., the higher the thixotropy index, the greater the degree of shear thinning).

The method comprises the steps of (1) providing a nozzle having a through material opening from an inlet end to an outlet end, an outer surface, and a distal end surface at the outlet end, (2) providing an air directing housing that has an inner surface defining, with the outer surface of the nozzle, an air chamber around the nozzle, which air directing housing includes a front end having an outer distal surface and has an air outlet opening for the air chamber between the inner and the distal surfaces of the air directing housing that is adapted to be positioned around the outer surface of the nozzle adjacent the front end of the nozzle, (3) sizing and spacing the housing and nozzle to position the distal surface of the nozzle between an outer position with a portion of the nozzle within the air outlet opening and the distal surface of the nozzle projecting past the outer distal surface of the air directing housing by about 1 millimeter, and an inner position with the nozzle out of the air outlet opening and the distal surface of the nozzle spaced from the inner surface of the air directing housing by about 2 millimeters, and so that when the nozzle is within the air outlet opening, there is an annular portion of the air outlet opening around the nozzle that has an area measured in a plane at a right angle to the axis of the nozzle in the range of about 5 to 15 square millimeters; (4) dispensing viscous material at a generally steady rate through the material opening of the nozzle from the inlet to the outlet end; (5) directing air into the air chamber so that air will escape through the air outlet opening around the nozzle to at least partially atomize material being dispensed from the nozzle; and (6) only adjusting the amount of air being directed into the air chamber to cause the viscous material being dispensed from the nozzle to be applied to a surface adjacent the nozzle in coatings of various widths and thicknesses.

Alternatively, by shutting off the supply of air to the air chamber, cylindrical beads of the material can be dispensed from the nozzle in the manner of a conventional caulking gun.

If the method is used to dispense materials having a low shear viscosity that is below the range indicated above, a cylindrical bead applied when air to the air chamber is shut off will tend to sag, and partially atomized coatings applied when air is directed through the air chamber will "run" or "flow out" and will not have the desired texture especially on vertical surfaces. If the method is used to dispense materials having a low shear viscosity that is above the range indicated above, excessive air pressure is required to dispense a cylindrical bead of the material when air to the air chamber is shut off, and poor material atomization will occur when air is directed through the air chamber. If the method is used to dispense materials having a high shear viscosity that is below the range indicated above, coatings applied when air is directed through the air chamber will tend to level and exhibit a flat, non-textured appearance. If the method is used to dispense materials having a high shear viscosity that is above the range indicated above, poor material atomization will occur when air is directed through the air chamber resulting in excessive overspray and stringy appearing sprayed seams. If the method is used to dispense materials with a thixotropy ratio of less than 4 while air is directed through the air chamber, coatings applied will exhibit high overspray, stringy appearance, and poor seam texture, and cylindrical beads dispensed when air to the air chamber is shut off will exhibit high sag. When the thixotropy ratio exceeds 20 coatings applied while air is directed through the air chamber will tend to level and lose texture, which may be desirable for some applications.

Air pressure supplied to the dispenser should be in the range of from 250 to 850 kilopascals (KPa), and preferably should be in the range from 400 to 700 kilopascals. At pressures below 250 KPa the material can be dispensed as a cylindrical bead, but can not be otherwise coated as there is insufficient air flow to atomize the material. At pressures above 850 Kpa the volume of material dispensed through the nozzle increases to a level where it can not be effectively atomized by air passing through the air chamber, resulting in sprayed coatings that are uneven, stringy, and of poor texture.

The portion of the air outlet opening around the nozzle should have a cross sectional area in the range of from 5 to 15 square millimeters and should be annular in shape with a generally uniform radius in the range of from 0.65 to 2.00 millimeters. The area of the air outlet opening around the nozzle in combination with the air pressure and the material shear-thinning properties determine the volume flow of material from the nozzle and the effectiveness of its subsequent atomization, which in turn influences the width, the thickness and the appearance (e.g., its texture, overspray, stringiness, etc) of the applied coating.

Preferably, the step of dispensing viscous material at a generally steady rate through the opening of the nozzle from the inlet to the outlet end comprises the steps of (1) providing a tubular member having an inner surface defining a through opening; (2) providing means for releasably sealing the inlet end of the nozzle to a front end of the tubular member with the openings in communication; (3) providing a piston within and extending across the through opening and in sealing engagement with the inner surface, the piston being axially moveable along the through opening between a rear end and the front end of the tubular member; (4) providing manually actuateable and adjustable means for applying air under pressure to cause forceful movement of the piston from the rear end to the front end of the tubular member; (5) positioning viscous material encased in a flexible sleeve in the chamber between the piston and the nozzle with the piston adjacent the rear end of the tubular member; (6) opening the end of the sleeve adjacent the nozzle; and (6) applying air under pressure to the piston at a rate selected by use of the manually actuateable and adjustable means to dispense material through the nozzle at the generally steady rate. After the material is dispensed, the method can further include cleaning the applicator for re-use by removing and discarding the sleeve and the nozzle.

Any shear-thinning, viscous coating material having the rheological profile defined above can be applied using the applicator and method of the invention. Such materials include, but are not limited to, sealers, primer coatings, undercoatings, paints, adhesives, and the like. Typically, these materials are used in automotive and marine applications. An especially preferred application is the coating or caulking of metal-to-metal joints (hemming flanges) to prevent corrosion and improve the appearance of the metal flanges formed in the repair and manufacture of vehicles.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
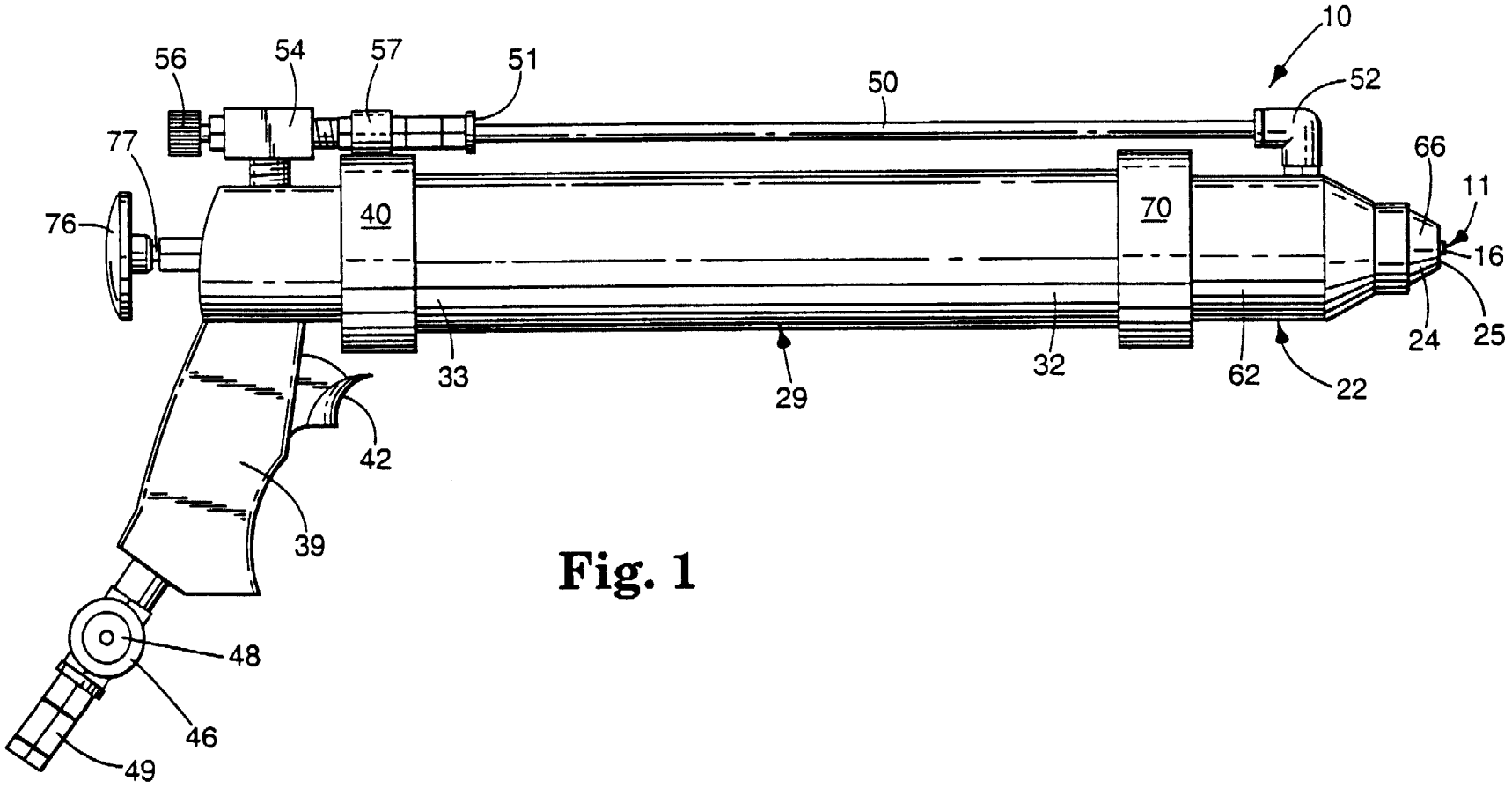
FIG. 1 is a side view of a applicator according to the present invention.

Referring now to the drawing, there is shown a pneumatic applicator according to the present invention generally designated by the reference numeral 10.

Figure 8:
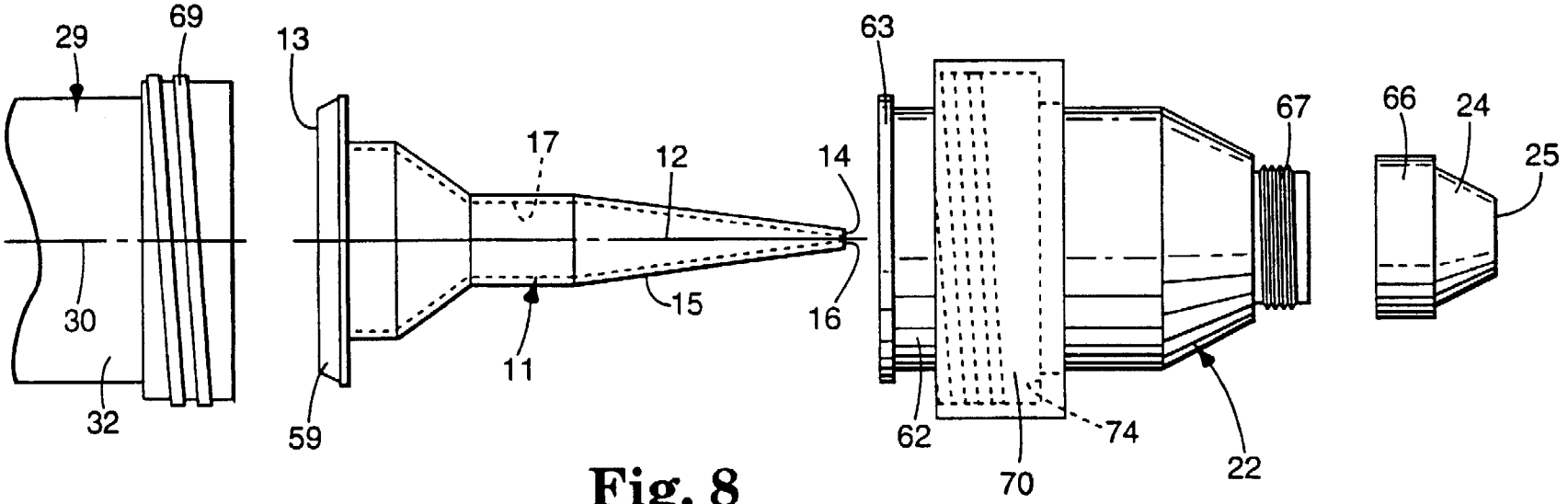
FIG. 8 is a fragmentary exploded view illustrating a fragment of a tubular portion, a nozzle, a two part air directing housing, and a collar included in the applicator illustrated in FIG. 1.
Figure 9:
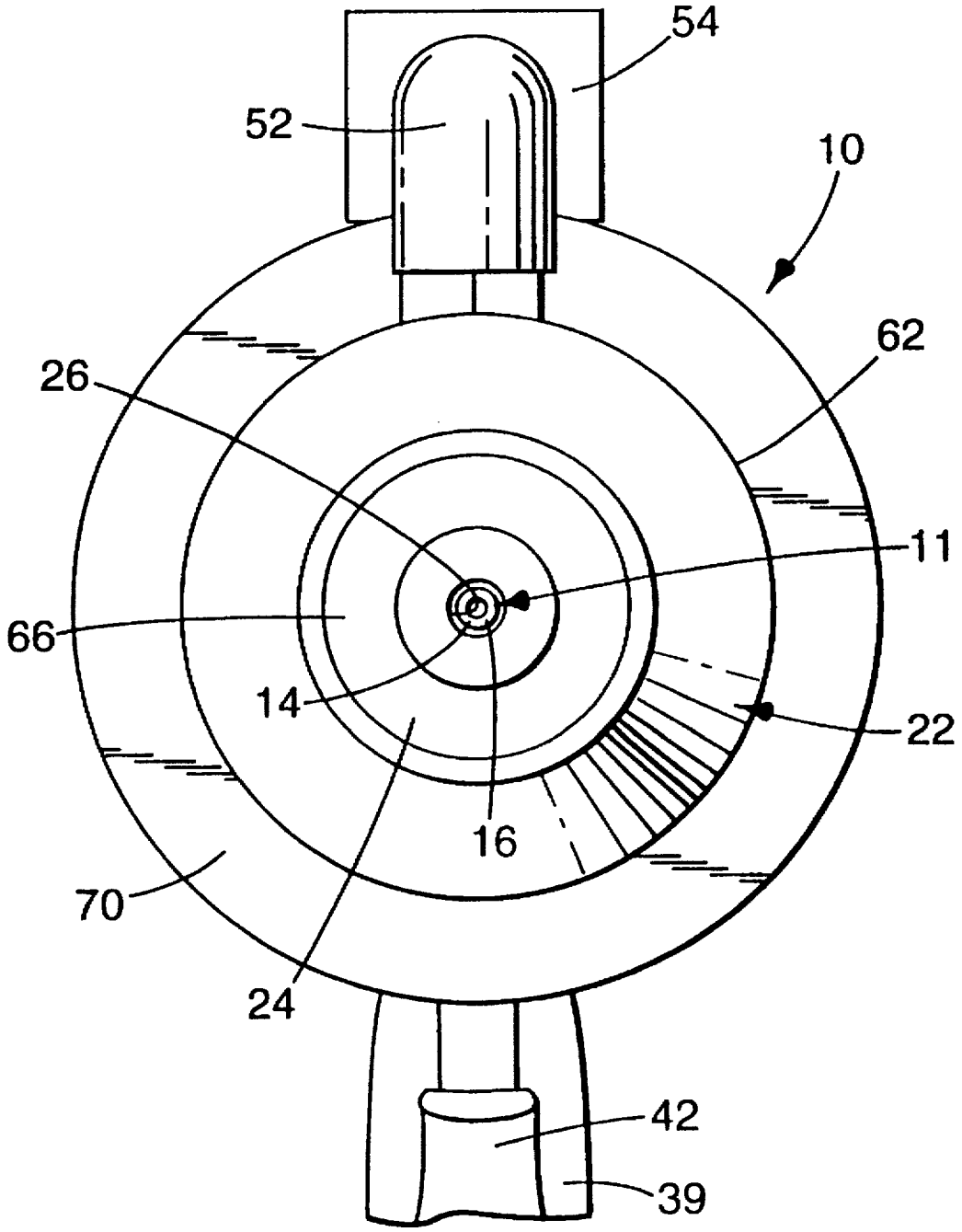
FIG. 9 is an enlarged front view of the applicator of FIG. 1.

Generally the applicator 10 comprises a nozzle 11 of polymeric material having an axis 12 (FIG. 8), inlet and outlet ends 13 and 14, an outer surface 15, a distal end surface 16 at the outlet end 14, and a converging through material opening 17 from the inlet end 13 to the outlet end 14 of the nozzle 11. Means later to be explained are provided for dispensing viscous material 20 through the opening 17 of the nozzle from its inlet end 13 to its outlet end 14 at a generally steady rate. The applicator 10 also includes an air directing housing 22 having an inner surface defining, with the outer surface 15 of the nozzle 11, an air chamber 23 around the nozzle 11. The air directing housing 22 includes a front end portion 24 having a distal surface 25 and defining an air outlet opening 26 for the air chamber 23 between the inner surface and the distal surface 25 of the air directing housing 22 adapted to be positioned (as illustrated) around the outer surface 15 of the nozzle 11 adjacent the front end 24 of the nozzle 11. The housing 22 and the nozzle 11 are sized and spaced so that the distal end surface 16 of the nozzle 11 can be in a position between an outer position (close to that illustrated) with a portion of the nozzle 11 within the air outlet opening 26 and the distal end surface 16 of the nozzle 11 projecting past the outer distal surface 25 of the air directing housing 22 by about 1 millimeter, and an inner position (not illustrated) with the nozzle 11 out of the air outlet opening 26 and the distal surface 16 of the nozzle spaced from the inner surface of the air directing housing 22 by about 2 millimeters; and so that when the nozzle 11 is within the air outlet opening 26, there is an annular portion of the air outlet opening 26 around the nozzle 11 that has an area measured in a plane at a right angle to the axis 12 of the nozzle 11 in the range of about 5 to 15 square millimeters. Manually adjustable means later to be explained are provided for directing air under pressure into the air chamber 23 so that when the viscous material 20 is dispensed through the nozzle 11 at a generally uniform rate, air can be directed into the air chamber 23 and will escape through the annular opening 26 around the nozzle 11 and the amount of air being directed into the air chamber 23 and expelled through the annular opening 26 can be adjusted to cause viscous material 20 being dispensed from the nozzle 11 to be at least partially atomized or sprayed and thereby applied to a surface adjacent the nozzle 11 in coatings of various widths and thicknesses.

As an example of an applicator adapted for applying a shear thinning viscous coating material having a low shear viscosity of 575,000 centipoise, a high shear viscosity of 75,000 centipoise, and a thixotropy ratio of 7.7, using air pressure of 415 kilopascals, the through opening 17 of the nozzle 11 at its distal surface 16 is generally circular with a diameter of about 0.089 inch, the inner surface and the outer surface 15 of the nozzle diverge to that distal surface 16 at an angle of about 6.5 degrees with respect to the axis 12 of the nozzle 11, the nozzle wall is about 0.049 inch thick adjacent that distal surface 16, the distal surfaces 25 and 16 of the housing 22 and the nozzle 11 are essentially co-planar, the cross sectional area of the annular portion of the air outlet opening 26 around the nozzle 11 is about 10 square millimeters, and the radius of that annular opening is about 1.30 millimeters.

Figure 3:
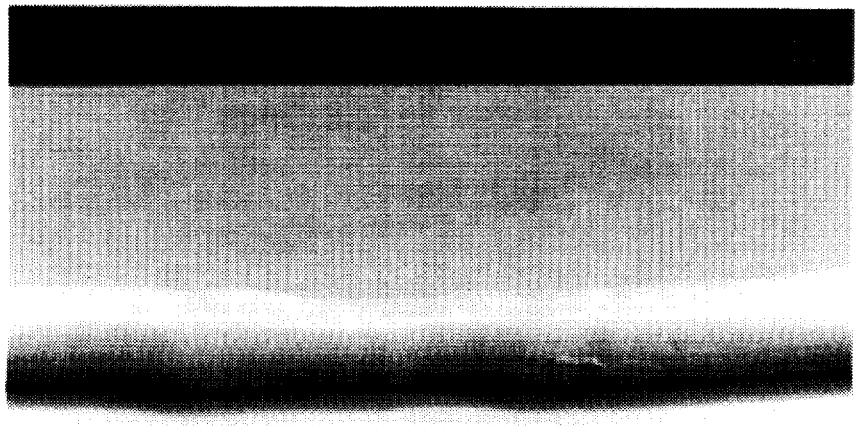
FIGS. 3 through 7 are sectional perspective views of coatings of viscous material having various widths and thicknesses that can be applied by the applicator of FIG. 1.
Figure 4:
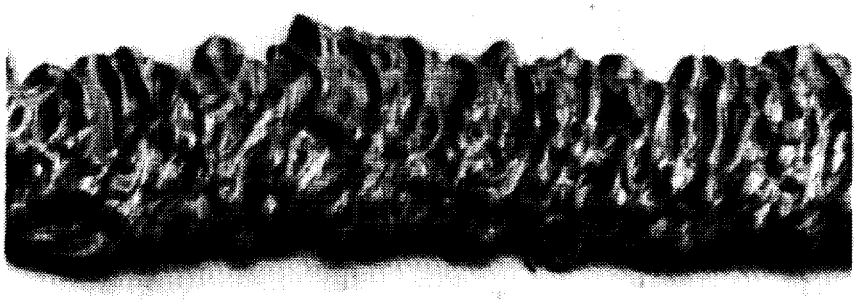
Figure 5:
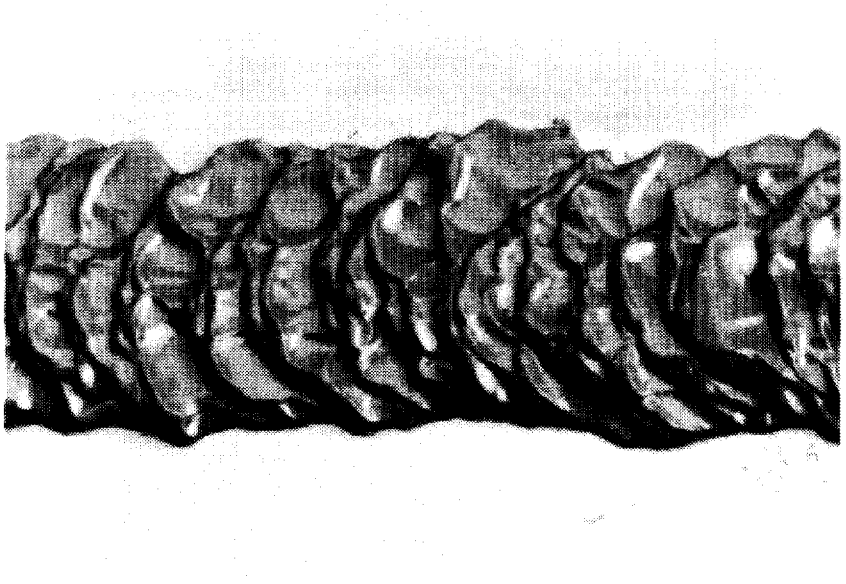
Figure 6:
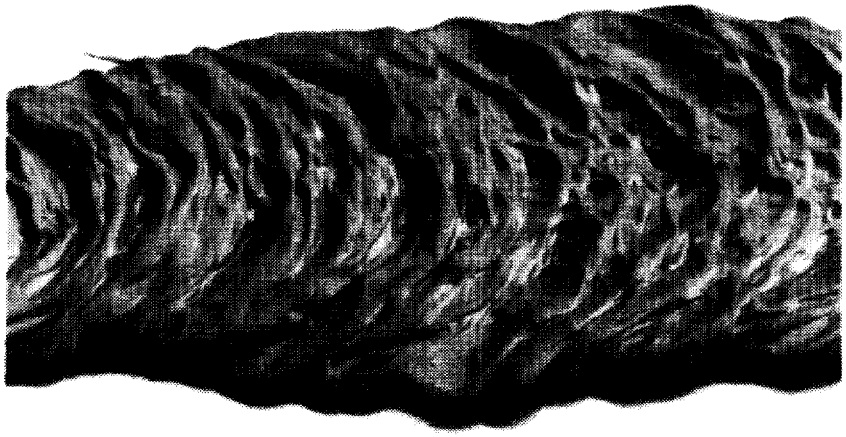
Figure 7:
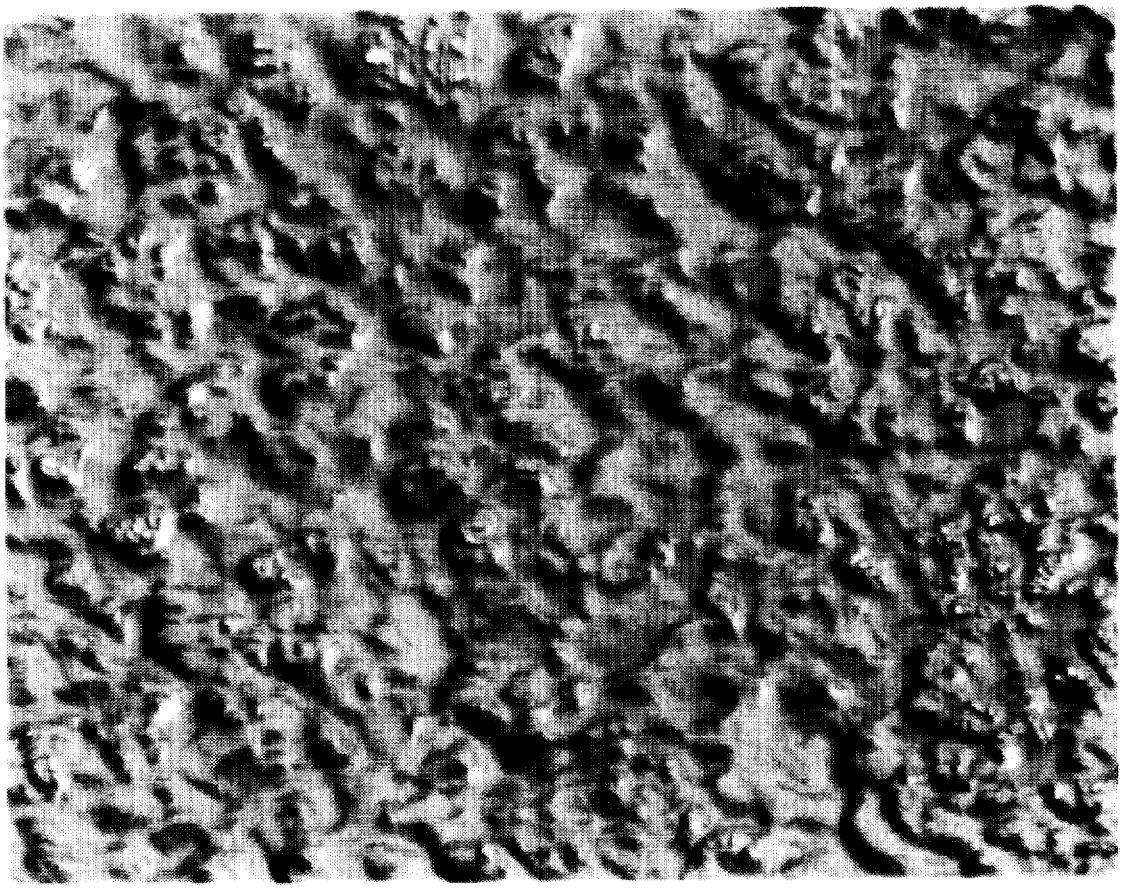

The effect of adjusting the air being expelled through the annular opening 26 on the width and thickness of the coating of viscous material 20 applied to a surface adjacent the nozzle 11 from viscous material 20 being dispelled from the nozzle 11 at a steady rate is illustrated in FIGS. 3 through 7. With no air expelled from the annular opening 26, the viscous material will be coated in a generally cylindrical bead as is illustrated in FIG. 3. When air is expelled from the annular opening 26 at increasing levels, the material will be at least partially sprayed or atomized, and the width of the layer deposited at each level will increase as its thickness decreases. This is illustrated from FIG. 4 to FIG. 7 for increasing amounts of air expelled through the annular portion of the air outlet opening 26 around the nozzle 11. The applicator 10 can apply good coatings of the type illustrated in FIG. 7 that are 5 or 6 inches in width and about 1 millimeter thick. The coating illustrated in FIG. 4 has spaced ridges along its length and is similar in appearance to coatings applied to some automobiles by factory equipment. Thus, the applicator 10 can be used to replicate such factory applied coatings when automobiles are repaired. Also, note that the applicator 10 can be used to apply coatings from cylindrical beads to wide coatings simply by only regulating the amount of air expelled through the air outlet opening 26. Also, the mixing of air (if any) and viscous material that causes the various coatings occurs outside or at the very end of the applicator 10 which facilitates its cleanup as will later be described in greater detail.

The means on the applicator 10 for dispensing viscous material through the nozzle 11 comprises a tubular member 29 having an axis 30 (see FIG. 8) and an inner surface defining a through opening 31 and having opposite front and rear axially spaced ends 32 and 33; (2) means for releasably sealing the inlet end 13 of the nozzle 11 to the front end 32 of the tubular member 29 with the openings 17 and 32 in communication; (3) a piston 35 within and extending across the through opening 31 and in sealing engagement with the inner surface defining it, the piston 35 being axially moveable along the through opening 31 between its rear and front ends 33 and 32; and (4) manually actuateable and adjustable means for applying air under a predetermined pressure to the side of the piston 35 adjacent the rear end 33 at a desired rate to cause forceful movement of the piston 35 from the rear end 33 to the front end 32 of the tubular member 29.

Figure 2:
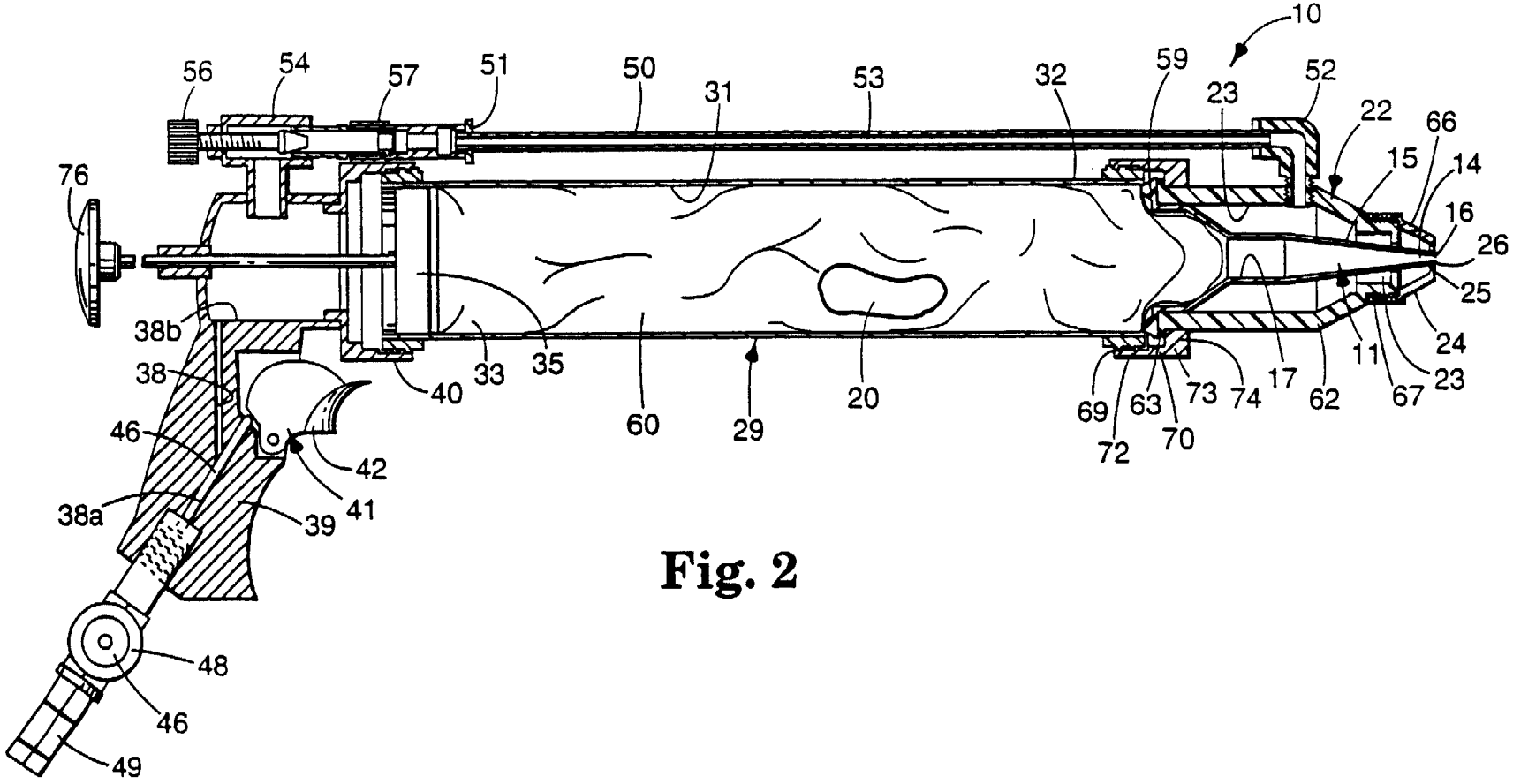
FIG. 2 is a longitudinal sectional view of the applicator illustrated in FIG. 1.

The manually actuateable and adjustable means for applying air under pressure to the side of the piston 35 comprises means for defining a primary air passageway 38 communicating with the rear end 33 of the tubular member 29. That means includes a pistol grip shaped portion 39 adapted for manual engagement, releasably attached to the rear end 33 of the tubular member 29 by an internally threaded collar 40, and defining spaced parts **38*a* and 38*b* of the primary air passageway 38. A conventional on off valve means 41 is mounted within the pistol grip portion 39 between the spaced parts 38*a* and 38*b* of the primary air passageway 38. The on off valve means or valve 41 comprises a trigger like member 42 pivotally mounted on the pistol grip portion 39 for movement from an outer position projecting from the surface of the pistol grip portion 39 (see FIGS. 1 and 2) to an inner position closer to the surface of the pistol grip portion 39 by the index finger of a person gripping the pistol grip portion 39; and relatively moveable valve members operable by the movement of the trigger like member 42 from its outer to its inner position from an off position with the valve members preventing air from passing between the parts 38*a* and 38*b* of the air passageway 38 to an on position with the valve members defining an opening communicating between the parts 38*a* and 38*b* of the air passageway 38. Means in the form of a spring between the valve members is provided for biassing the trigger like member 42** to its outer position and the valve members to their off position.

An adjustable primary valve means or needle valve 46 is positioned in the passageway part **38*a* of the primary passageway 38 and comprises a manually operable moveable member that is rotatable by a knob 48 to regulate the rate of air flowing through the primary air passageway 38 when the on off valve means 41 is moved to its on position by pulling the trigger like member 42; and means in the form of a conventional male quick disconnect portion 49 is provided for coupling the end of the primary passageway part 38*a* opposite the tubular member 29** to a source of air under a regulated amount of pressure.

The manually adjustable means for directing air under pressure into the air chamber 23 includes an adjustable secondary valve means or needle valve 54, one side of which is coupled to the pistol grip portion 39 with the inlet side of the valve 54 in communication with the primary air passageway part **38*b* between the on-off valve means 41 and the tubular member 29, a manually operable separable quick disconnect means or connector 57 having one end connected to the outlet of the needle valve 54, and a flexible plastic hose 50, one end of which is connected by an end fitting 51 to the end of the connector 57 opposite the valve 54 and the other end of which is connected by an elbow fitting 52 to the air chamber 23. The combination of the valve 54, connector 57 and hose 50 define a secondary air passageway 53 between the air chamber 23 and the primary air passageway part 38*b* between the on-off valve means 41 and the tubular member 29; and the needle valve 54 includes a moveable member manually operable by a knob 56 to regulate the rate of flow of air through the secondary air passageway 53. The separable quick disconnect connector 57 facilitates separating the air directing housing 22 and the nozzle 11 from the front end 32 of the tubular member 29 to facilitate placing viscous material 20 in the tubular member 29**.

The nozzle 11 is molded of polymeric material (e.g., polypropylene or polyethylene) and includes a sealing flange 59 (FIG. 8) extending radially of its axis 12. The sealing flange 59 defines the rear end of the nozzle 11 and has a periphery shaped and adapted to make sealing engagement within a groove around the front end 32 of the tubular member 29. With the piston 35 adjacent the rear end 33 of the tubular member 29 and the nozzle 11 separated from the front end 32 of the tubular member 29, viscous material 20 encased only in a flexible sleeve 60 can be positioned within the through opening 31 of the tubular member 29, the end of the sleeve 60 at the front end 32 of the tubular member 29 can be opened, and the flange 59 on the nozzle 11 can again be sealed across the front end 32 of the tubular member 29. The pneumatic applicator 10 can then be used to apply the viscous coating material 20 in the sleeve 60, and subsequently, the applicator 10 can be cleaned for re-use by little more than removing and discarding the empty sleeve 60 and the nozzle 11.

The air directing housing 22 comprises a first part 62 having a radially outwardly projecting flange 63 adapted for sealing engagement with the side of the sealing flange 59 on the nozzle 11 opposite the tubular member 29, and four radially inwardly projecting walls 64 (FIG. 2) having inner edges adapted to closely receive a portion of the outer surface 15 of the nozzle 11 to locate the nozzle 15 within the air directing housing 22. The air directing housing 22 also includes a second part 66 providing the outlet end portion 24 having the distal surface 25. The second part 66 of the air directing housing 22 is threadably engaged around a collar 67 on the first part 62 of the air directing housing 22 which affords fine adjustment to assure that the distal surfaces of the housing 22 and the nozzle are in desired relative locations such as substantially co-planer, and facilitates any cleaning of the air directing housing 22 that may be needed.

The applicator 10 includes manually releasable means for attaching the nozzle 11 and the air directing housing 22 to the front end 32 of the tubular member 29. The tubular member 29 has a helical thread 69 partially defining its outer surface adjacent its front end 32. The applicator 10 includes a collar 70 having an inner surface, a helical radially inwardly thread partially defining its inner surface adapted for releasable engagement with the helical thread 69 on the tubular member 29, and a ring 74 projecting radially inwardly past the thread and extending around the air directing housing 22 adjacent the radially outwardly projecting flange 63, which ring 74 is adapted to press the radially outwardly projecting flange 63 toward the front end 32 of the tubular member 29 when the collar 70 is threadably engaged with the tubular member 29. By unscrewing the collar 70 from the tubular member 29 and separating the parts of the quick disconnect 57, the air directing housing 22 and the nozzle 11 can easily be separated from the front end of the tubular member 29.

To dispense viscous material 20 at a generally steady rate through the nozzle 11, viscous material 20 is first positioned in the through opening 31 between the piston 35 and the nozzle 11 by (1) first positioning the piston 35 adjacent the rear end 33 of the tubular member 29, which can be done by pulling a knob 76 attached by a rod 77 to the piston 35 through an air tight seal 78; (2) separating the air directing housing 22 and the nozzle 11 from the front end 24 of the tubular member 29 by unscrewing the collar 70 from the tubular member 29 and separating the parts of the quick disconnect connector 57; (3) positioning viscous material 20 encased only in the flexible sleeve 60 within the through opening 31 of the tubular member 29; (4) opening the end of the sleeve 60 at the front end 32 of the tubular member 29 by cutting or tearing the sleeve 60 with a knife or other sharp implement; and (6) sealing the nozzle 11 and air directing housing 22 across the front end 32 of the tubular member 29 by again engaging the collar 70 with the tubular member 29. By pulling the trigger like member 42, air can then be applied under pressure to the piston 35 at a rate selected by adjusting the knob 48 on the needle valve to dispense viscous material 20 through the nozzle 11 at a generally steady rate. The width and thickness of the coating of viscous material 20 applied to a surface adjacent the nozzle 11 from the viscous material 20 thus being dispelled from the nozzle 11 can then be adjusted by rotating the knob 56 on the needle valve 54 to adjust the atomization of the dispensed material and thereby coat the material in coatings of various widths and thicknesses, including those illustrated in FIGS. 3 through 7 and further described above.

After the viscous material 20 is dispensed, the applicator 10 can be cleaned for re-use by releasing the collar 67 from the tubular member 29, and then removing and discarding the empty sleeve 60 and the nozzle 11.

The present invention has now been described with reference to one embodiment thereof. It will be apparent to those skilled in the art that many changes can be made in the embodiment described without departing from the scope of the present invention. Thus, the scope of the present invention should not be limited to the structure and method described in this application, but only by the structure and method described by the language of the claims and the equivalents thereof.

We claim:

1. A method for applying to substrates in coatings of various widths and thicknesses shear thinning viscous coating materials having a range of properties including a low shear rate viscosity in the range of 100,000 to 800,000 centipoise as measured with a Brookfield viscometer at 2 revolutions per minute using a number 7 spindle; a high shear viscosity in the range of 40,000 to 100,000 centipoise as measured with a Brookfield viscometer at 20 revolutions per minute using a number 7 spindle; and a thixotropy index, defined as the ratio of the low shear rate viscosity to the high shear rate viscosity, that is greater than 4, said method comprising the steps of:

providing a nozzle having a central axis, axially spaced inlet and outlet ends, an outer surface, a distal end surface at the outlet end, and a through axially extending opening from the inlet end to the outlet end;

providing an air directing housing that has an inner surface defining, with the outer surface of the nozzle, an air chamber around the nozzle, which air directing housing includes a front end having an outer distal surface and has an air outlet opening for the air chamber between the inner and the distal surfaces of the air directing housing, which air outlet opening is adapted to be positioned around the outer surface of the nozzle adjacent the front end of the nozzle;

sizing and spacing the housing and nozzle so that the distal surface of the nozzle is in a position between an outer position with a portion of the nozzle within the air outlet opening and the distal surface of the nozzle projecting past the outer distal surface of the air directing housing by about 1 millimeter, and an inner position with the nozzle out of the air outlet opening and the distal surface of the nozzle spaced from the inner surface of the air directing housing by about 2 millimeters, and so that when the nozzle is within the air outlet opening, there is an annular portion of the air outlet opening around the nozzle that has an area measured in a plane at a right angle to the axis of the nozzle in the range of about 5 to 15 square millimeters;

dispensing a shear thinning viscous coating material having a low shear rate viscosity in the range of 100,000 to 800,000 centipoise as measured with a Brookfield viscometer at 2 revolutions per minute using a number 7 spindle; a high shear viscosity in the range of 40,000 to 100,000 centipoise as measured with a Brookfield viscometer at 20 revolutions per minute using a number 7 spindle; and a thixotropy index, defined as the ratio of the low shear rate viscosity to the high shear rate viscosity, that is greater than 4 at a generally constant rate through the opening of the nozzle from the inlet to the outlet end;

directing air into the air chamber so that air will flow through the annular opening around the nozzle and contact the shear thinning viscous coating material being dispensed through the opening of the nozzle; and only adjusting the amount of air being directed into the air chamber to cause the shear thinning viscous coating material being dispensed from the nozzle to be applied to a surface adjacent to the nozzle in coatings of various widths and thicknesses.

2. A method for applying shear thinning viscous coating materials according to claim 1 wherein said sizing and spacing step comprises sizing and spacing the housing and nozzle so that the distal surfaces of the housing and nozzle are essentially co-planar, and the portion of the air outlet opening around the nozzle has an area measured in a plane at a right angle to the axis of the nozzle of about 10 square millimeters.

3. A method according to claim 1 for applying shear thinning viscous coating materials wherein the shear thinning viscous coating material dispensed in said dispensing step has a low shear rate viscosity in the range of 300,000 to 600,000 centipoise as measured with a Brookfield viscometer at 2 revolutions per minute using a number 7 spindle; a high shear viscosity in the range of 60,000 to 80,000 centipoise as measured with a Brookfield viscometer at 20 revolutions per minute using a number 7 spindle; and a thixotropy index that is greater than 5.

4. A method for applying shear thinning viscous coating materials according to claim 1 wherein said step of dispensing shear thinning viscous coating material at a generally constant rate through the opening of the nozzle from the inlet to the outlet end comprises the steps of;

providing a tubular member having a central axis, opposite front and rear axially spaced ends, and an inner surface around said axis defining a through opening extending axially through said tubular member between said front and rear ends of said tubular member;

providing means for releasably sealing the inlet end of the nozzle to the front end of the tubular member with the opening through the nozzle in communication with the opening through the tubular member;

providing a piston within and extending across the through opening and in sealing engagement with the inner surface, the piston being axially moveable along the through opening between the rear and front ends;

providing manually actuateable and adjustable means for applying air under pressure to the side of the piston adjacent the rear end at a desired rate to cause forceful movement of the piston from the rear end to the front end of the tubular member;

positioning the shear thinning viscous coating material in the chamber between the piston and the nozzle by the steps of;

positioning the piston adjacent the rear end of the tubular member;

separating the nozzle from the front end of the tubular member;

positioning the shear thinning viscous coating materials material encased only in a flexible sleeve within the through opening of the tubular member;

opening the end of the sleeve at the front end of the tubular member;

sealing the nozzle across the front end of the tubular member; and applying air under pressure to the piston at a rate selected by use of the manually actuateable and adjustable means to dispense the shear thinning viscous coating material through the nozzle at the generally constant rate.

5. A method for applying shear thinning viscous coating materials according to claim 4 wherein after the material is dispensed, said method further includes the step of removing and discarding the sleeve and the nozzle.

* * * * *